US007792673B2

(12) United States Patent
Oh et al.

(10) Patent No.: US 7,792,673 B2
(45) Date of Patent: Sep. 7, 2010

(54) METHOD OF GENERATING A PROSODIC MODEL FOR ADJUSTING SPEECH STYLE AND APPARATUS AND METHOD OF SYNTHESIZING CONVERSATIONAL SPEECH USING THE SAME

(75) Inventors: Seung Shin Oh, Daejeon (KR); Sang Hun Kim, Daejeon (KR); Young Jik Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 929 days.

(21) Appl. No.: 11/593,852

(22) Filed: Nov. 7, 2006

(65) Prior Publication Data

US 2007/0106514 A1 May 10, 2007

(30) Foreign Application Priority Data

Nov. 8, 2005 (KR) ..... 10-2005-0106584

(51) Int. Cl.
*G10L 13/06* (2006.01)
*G10L 13/08* (2006.01)

(52) U.S. Cl. ..... 704/266; 704/260; 704/268

(58) Field of Classification Search ..... None
See application file for complete search history.

(56) References Cited

U.S. PATENT DOCUMENTS 6,810,378 B2 10/2004 Kochanski et al.
6,826,530 B1 * 11/2004 Kasai et al. ..... 704/258
7,096,183 B2 * 8/2006 Junqua ..... 704/258
7,415,413 B2 * 8/2008 Eide et al. ..... 704/260
2002/0188449 A1 12/2002 Nukaga et al.
2005/0096909 A1 * 5/2005 Bakis et al. ..... 704/260
2008/0065383 A1 * 3/2008 Schroeter ..... 704/260

FOREIGN PATENT DOCUMENTS

JP 11-353150 12/1999
JP 2001-216295 8/2001
WO WO01/97063 12/2001
WO WO2005/050624 6/2005

OTHER PUBLICATIONS

Iida, Akemi et al., "A corpus-based speech synthesis system with emotion," Speech Communication 40 161-187, 2003.

* cited by examiner

*Primary Examiner*—Matthew J Sked
(74) *Attorney, Agent, or Firm*—Ladas & Parry LLP

(57) ABSTRACT

An apparatus and method for adjusting the friendliness of a synthesized speech and thus generating synthesized speech of various styles in a speech synthesis system are provided. The method includes the steps of defining at least two friendliness levels; storing recorded speech data of sentences, the sentences being made up according to each of the friendliness levels; extracting at least one of prosodic characteristics for each of the friendliness levels from the recorded speech data, said prosodic characteristics including at least one of a sentence-final intonation type, boundary intonation types of intonation phrases in the sentence, and an average value of $F_0$ of the sentence, with respect to the recorded speech data; and generating a prosodic model for each of the friendliness levels by statistically modeling the at least one of the prosodic characteristics.

8 Claims, 4 Drawing Sheets

| SPEECH ACT AND SENTENCE TYPE | | SENTENCE | + friendly | | − friendly | |
|---|---|---|---|---|---|---|
| | | | $F_0$ VALUE OF SENTENCE HEAD (Hz) | SENTENCE FINAL INTONATION | $F_0$ VALUE OF SENTENCE HEAD (Hz) | SENTENCE FINAL INTONATION |
| opening | | HELLO. | 214.7 | H2 | 211.8 | HL1 |
| request-information | wh | WHAT CAN I DO FOR YOU? | 238.3 | H2 | 230.0 | HL1 |
| | yes-no | IS THERE A MOVIE THAT YOU WOULD LIKE TO WATCH? | 309.0 | H2 | 300.9 | H2 |
| | other | YOUR NAME PLEASE. | 384.4 | H1 | 352.2 | L |
| | | SOCIAL SECURITY NUMBER PLEASE. | 310.5 | LH2 | 283.9 | L |
| give-information | | THE CHARGE IN PEAK SEASON COMES TO 20,000 WON. | 396.9 | H1 | 356.0 | L |
| | | TIMES CURRENTLY AVAILABLE FOR RESERVATION ARE 10 O"CLOCK, 18 O"CLOCK, 23 O"CLOCK. | 245.7 | H1 | 241.7 | L |
| call | | CUSTOMER. | 292.9 | H2 | 281.7 | HL |
| acknowledge | | I SEE. | 268.7 | HL2 | 265.2 | HL1 |
| commit | | PLEASE ALLOW ME TO | 422.3 | H2 | 379.5 | L |
| | | CANCEL IT RIGHT AWAY. | 291.8 | LH2 | 282.9 | L |
| Request-action | | PLEASE CALL US IF YOU HAVE ANY QUESTIONS OR CONCERNS. | 317.6 | LH2 | 270.2 | L |
| thank | | THANK YOU FOR YOUR PATRONAGE. | 252.7 | H2 | 234 | L |
| closing | | HAVE A NICE DAY. | 335.3 | H1 | 300.1 | L |

(H: high, L: low, HL: high-low, LH: low-high, 1, 2 : degree of high)

FIG. 2

| SPEECH ACT AND SENTENCE TYPE | | SENTENCE | + friendly | | - friendly | |
|---|---|---|---|---|---|---|
| | | | $F_0$ VALUE OF SENTENCE HEAD (Hz) | SENTENCE FINAL INTONATION | $F_0$ VALUE OF SENTENCE HEAD (Hz) | SENTENCE FINAL INTONATION |
| opening | | HELLO. | 214.7 | H2 | 211.8 | HL1 |
| request-information | wh | WHAT CAN I DO FOR YOU? | 238.3 | H2 | 230.0 | HL1 |
| | yes-no | IS THERE A MOVIE THAT YOU WOULD LIKE TO WATCH? | 309.0 | H2 | 300.9 | H2 |
| | other | YOUR NAME PLEASE. | 384.4 | H1 | 352.2 | L |
| | | SOCIAL SECURITY NUMBER PLEASE. | 310.5 | LH2 | 283.9 | L |
| give-information | | THE CHARGE IN PEAK SEASON COMES TO 20,000 WON. | 396.9 | H1 | 356.0 | L |
| | | TIMES CURRENTLY AVAILABLE FOR RESERVATION ARE 10 0"CLOCK, 18 0"CLOCK, 23 0"CLOCK. | 245.7 | H1 | 241.7 | L |
| call | | CUSTOMER. | 292.9 | H2 | 281.7 | HL |
| acknowledge | | I SEE. | 268.7 | HL2 | 265.2 | HL1 |
| commit | | PLEASE ALLOW ME TO | 422.3 | H2 | 379.5 | L |
| | | CANCEL IT RIGHT AWAY. | 291.8 | LH2 | 282.9 | L |
| Request-action | | PLEASE CALL US IF YOU HAVE ANY QUESTIONS OR CONCERNS. | 317.6 | LH2 | 270.2 | L |
| thank | | THANK YOU FOR YOUR PATRONAGE. | 252.7 | H2 | 234 | L |
| closing | | HAVE A NICE DAY. | 335.3 | H1 | 300.1 | L |

(H: high, L: low, HL: high-low, LH: low-high, 1, 2 : degree of high)

FIG. 5

```
<attitude type="friendly" degree="2">HELLO?</attitude>
<attitude type="friendly" degree="2">THIS IS ABC TELECOM CUSTOMER SERVICE CENTER.</attitude>
<attitude type="friendly" degree="2">WHAT CAN I DO FOR YOU?</attitude>
<attitude type="friendly" degree="1">I WOULD LIKE TO KNOW ABOUT YOUR RATES.</attitude>
<attitude type="friendly" degree="2">OH, I SEE.</attitude>
<attitude type="friendly" degree="2">PLEASE TELL ME YOUR CELL PHONE NUMBER.</attitude>
<attitude type="friendly" degree="1">016-9226-8527 .</attitude>
```

METHOD OF GENERATING A PROSODIC MODEL FOR ADJUSTING SPEECH STYLE AND APPARATUS AND METHOD OF SYNTHESIZING CONVERSATIONAL SPEECH USING THE SAME

CROSS-REFERENCE TO RELATED APPLICATION

This application claims priority to and the benefit of Korean Patent Application No. 2005-106584, filed Nov. 8, 2005, the disclosure of which is incorporated herein by reference in its entirety.

BACKGROUND

1. Field of the Invention

The present invention relates to a speech synthesis system, and more particularly, to an apparatus and method for generating various types of synthesized speech by adjusting the friendliness of the speech output from a speech synthesizer.

2. Discussion of Related Art

A speech synthesizer is a device that synthesizes and outputs previously stored speech data in response to input text. The speech synthesizer is only capable of outputting speech data to a user in a predefined speech style.

With recent developments in the field of speech synthesis systems, demand for relatively soft speech such as conversation with an agent for intelligent robot service, voice messaging through a personal communication medium, and so forth, has increased. In other words, even though the same message is delivered, the degree of friendliness to a listener differs with the conversation situation, attitude toward the conversing party, and the object of the conversation. Therefore, various speech styles are required for conversational speech.

However, a currently used speech synthesizer uses synthesized speech in only one speech style, and thus is not suitable for expressing diverse emotions.

In order to solve this problem, simply, speech information in which utterances in various speech styles are mixed can be stored in a database and used. However, when the stored speech information only is used without consideration of various speech styles, synthesized speech of different styles end up being randomly mixed in a speech synthesizing process.

SUMMARY

The present invention is directed to an apparatus and method for generating various types of synthesized speech by adjusting the friendliness of the speech output in a speech synthesis system.

The present invention is also directed to a speech synthesis apparatus and method for setting up friendliness as a criterion for classifying a speech style and thus making it possible to adjust the friendliness when generating a synthesized speech.

The present invention is also directed to a speech synthesis apparatus and method for generating realistic speech of various styles using a database having voice information of a single speaker.

The present invention is also directed to a speech synthesis apparatus and method for generating speech of various styles to converse more realistically and appropriately with respect to a conversation topic or situation.

One aspect of the present invention provides a method of generating a prosodic model for adjusting a speech style, the method comprising the steps of defining at least two friendliness levels; storing recorded speech data of sentences, the sentences being made up according to each of the friendliness levels; extracting at least one of prosodic characteristics for each of the friendliness levels from the recorded speech data, said prosodic characteristics including at least one of a sentence-final intonation type, boundary intonation types of intonation phrases in the sentence, and an average value of $F_0$ of the sentence, with respect to the recorded speech data; and generating a prosodic model for each of the friendliness levels by statistically modeling the at least one of the prosodic characteristics.

In one embodiment, the prosodic model may include information of speech act and sentence style and prosodic information.

Preferably, the information of speech act and sentence type is "opening," "request-information," "give-information," "request-action," "propose-action," "expressive", "commit", "call", "acknowledge", "closing", "statement", "command", "wh-question", "yes-no question", "proposition" or "exclamation."

Preferably, the prosodic information includes $F_0$ of the head of the sentence and sentence-final intonation for each of the friendliness levels.

Another aspect of the present invention provides a speech synthesis method for adjusting a speech style, comprising the steps of: (a) receiving a sentence with a marked friendliness level; (b) selecting a prosodic model based on the marked friendliness level of the sentence; and (c) generating a synthesized speech of the sentence with the marked friendliness level by obtaining speech segments from a synthesis unit database on the basis of the selected prosodic model, the synthesis unit database storing speech segments for each friendliness level.

In one embodiment, the synthesis unit database stores sentence data and the corresponding speech segments recorded according to each friendliness level, the sentence data including information of speech act, a sentence type, or a sentence final verbal-ending or a combination thereof according to each friendliness level In one embodiment, the step (c) includes the steps of: (c1) extracting the speech segments from the synthesis unit database using prosodic information of the sentence based on the selected prosodic model; and (c2) synthesizing the extracted speech segments.

Another aspect of the present invention provides a speech synthesis apparatus for adjusting a speech style, comprising: a prosodic model storage for storing prosodic models for each friendliness level, the prosodic models including sentence data and the corresponding prosodic characteristics for each friendliness level; a synthesis unit database for storing speech segments of each friendliness level; and a speech generator for selecting the prosodic model based on a marked friendliness level of an input sentence and obtaining the speech segments from the synthesis unit database on the basis of the selected prosodic model to generate a synthesized speech of the input sentence.

BRIEF DESCRIPTION OF THE DRAWINGS

The above and other features and advantages of the present invention will become more apparent to those of ordinary skill in the art by describing in detail preferred embodiments thereof with reference to the attached drawings in which:

FIG. 2 is a table showing exemplary voice-recorded sentences and the corresponding prosodic information that is extracted therefrom to generate prosodic models according to the present invention.

FIG. 5 shows exemplary input sentences expressed using a markup language according to the conversational speech synthesis method of the present invention.

DETAILED DESCRIPTION OF EXEMPLARY EMBODIMENTS

Hereinafter, exemplary embodiments of the present invention will be described in detail. However, the present invention is not limited to the embodiments disclosed below, but can be implemented in various modified forms. Therefore, the exemplary embodiments are provided for complete disclosure of the present invention and to fully inform the scope of the present invention to those of ordinary skill in the art.

Figure 1:
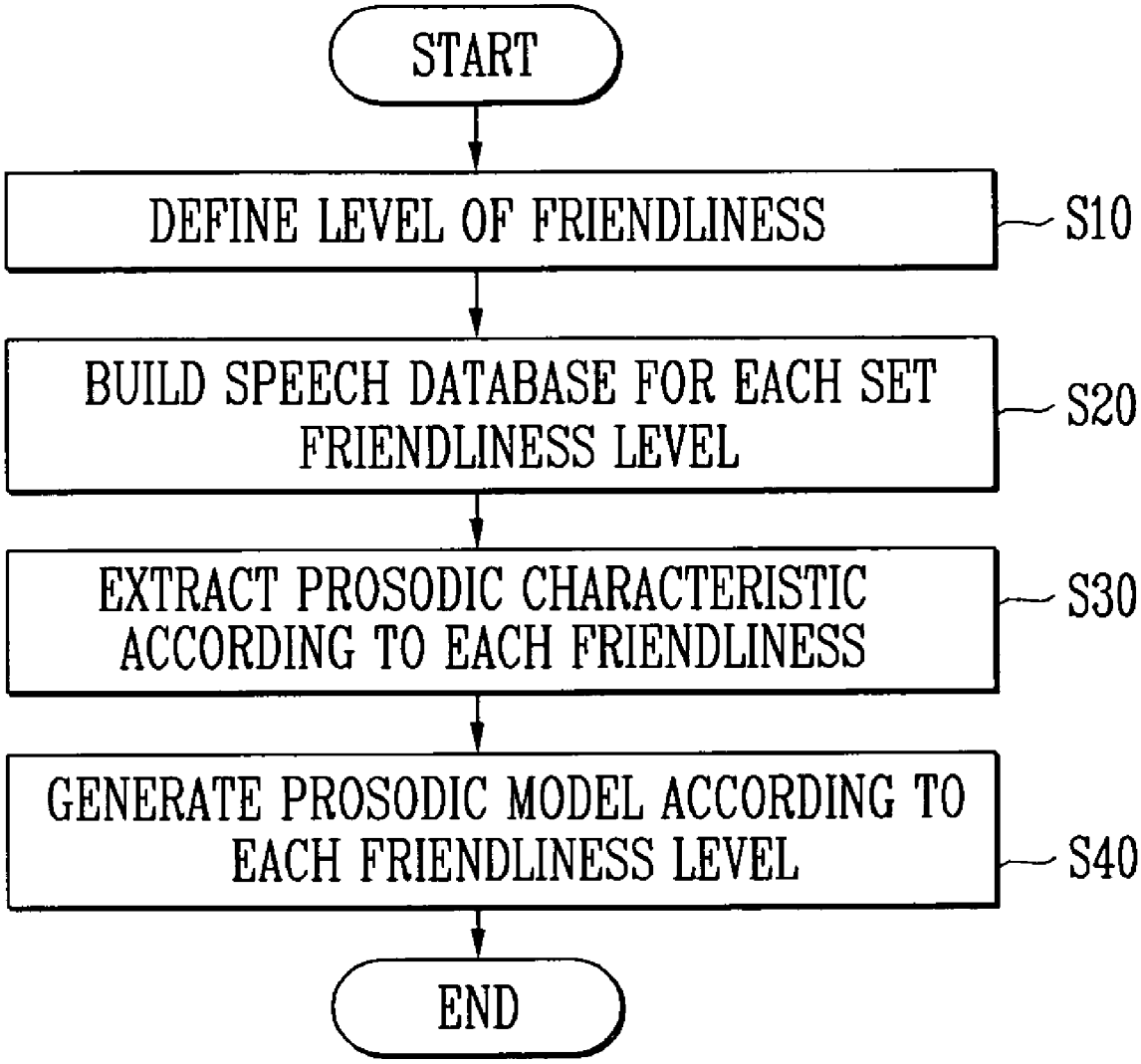
FIG. 1 is a flowchart showing a method of generating a prosodic model for adjusting a speech style according to an exemplary embodiment of the present invention.

FIG. 1 is a flowchart showing a method of generating a prosodic model according to the present invention.

Referring to FIG. 1, first, friendliness levels are defined (S10). The friendliness levels may be defined according to the intentions of a developer. The friendliness may be classified into at least two levels.

Text data including various speech acts, sentence types, and sentence-final verbal-endings are made up. Then, the text data are read by at least one speaker, according to the different friendliness levels, and then digitally recorded (S20).

Then, prosodic features of each friendliness level are extracted from the recorded data, according to the speech acts, sentence types and/or sentence final verbal-ending types. The prosodic features may include at least one of sentence-final intonation type, boundary intonation types of intonation phrases in a sentence, an average value of $F_0$ of the head of the sentence or the entire sentence, and so forth (S30).

Prosodic models to which friendliness levels are applied are generated by statistically modeling the extracted prosodic features (S40).

FIG. 2 is a table showing exemplary voice-recorded sentences and the corresponding prosodic information that is extracted therefrom to generate prosodic models according to the present invention. The recorded sentences can be classified according to speech act and sentence types. The extracted prosodic information includes $F_0$ of the head of the sentence and sentence-final intonation of each of the friendliness levels, "+friendly" and "−friendly."

The speech act, which represents a speaker's intention, is used to classify sentences according to their function, not external type. As shown in the first column in the table of FIG. 2, the speech act and sentence types can be classified into "opening," "request-information," "give-information," "request-action," "closing," and so forth. The "request-information" can be further classified into a wh-question, a yes-no question, and other forms.

The exemplary sentences corresponding to each speech act and sentence type are shown in the second column. The sentences in text format may be used in response to questions, etc. intended by a speech act and sentence style.

Also, prosodic characteristics extracted from the speech data of each friendliness level are shown in the third column. First, as shown in FIG. 2, friendliness can be classified into two levels corresponding to a style showing friendship and another style not showing friendship. Here, "+friendly" denotes speech data showing friendship, and "−friendly" denotes speech data not showing friendship. With respect to a sentence corresponding to each friendliness level, the $F_0$ value of the sentence head and the type of a manually tagged sentence final intonation are also shown.

As illustrated in FIG. 2, the $F_0$ value of the speech of a sentence head in data of "+friendly" is higher than that in data of "−friendly," and intonation with a rising tone indicated with "H" is generally shown in a sentence final intonation. The prosodic characteristics are statistically modeled to generate prosodic models for the synthesized speech of each friendliness level.

An exemplary embodiment of an apparatus and method for synthesizing conversational speech using the prosodic models generated as described above will be described below with reference to the appended drawings.

Figure 3:
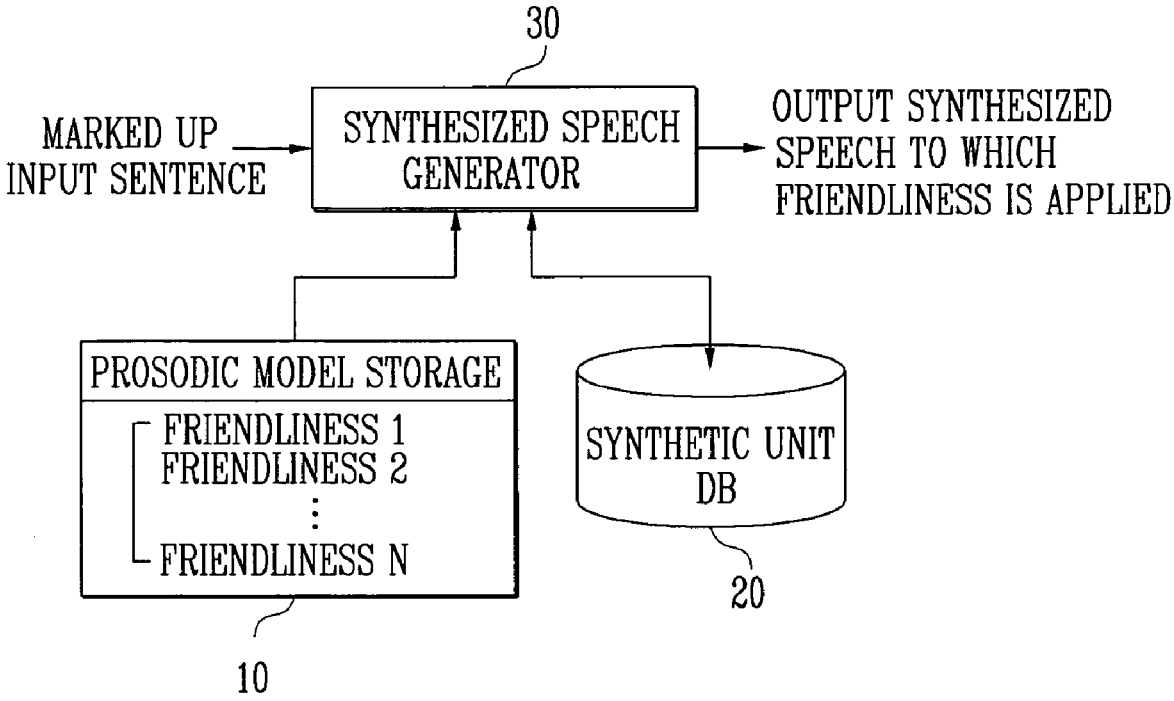
FIG. 3 is a block diagram of a friendliness adjusting apparatus for synthesizing conversational speech according to an exemplary embodiment of the present invention.

FIG. 3 is a block diagram of a friendliness adjusting apparatus for synthesizing conversational speech according to an exemplary embodiment of the present invention.

Referring to FIG. 3, the conversational speech synthesis apparatus includes a prosodic model storage 10 in which prosodic models are stored according to prosodic characteristics on the basis of text information and the friendliness level of an input sentence, a synthesis unit database 20 that stores speech segments required for expressing speech of all friendliness levels, and a speech generator 30 that obtains the corresponding speech segment from the synthesis unit database 20 on the basis of a prosodic model selected from the prosodic model storage 10 and generates a synthesized speech to which a requested friendliness level is applied.

The operation of the speech synthesis apparatus will be described in detail below with reference to the appended drawings.

Figure 4:
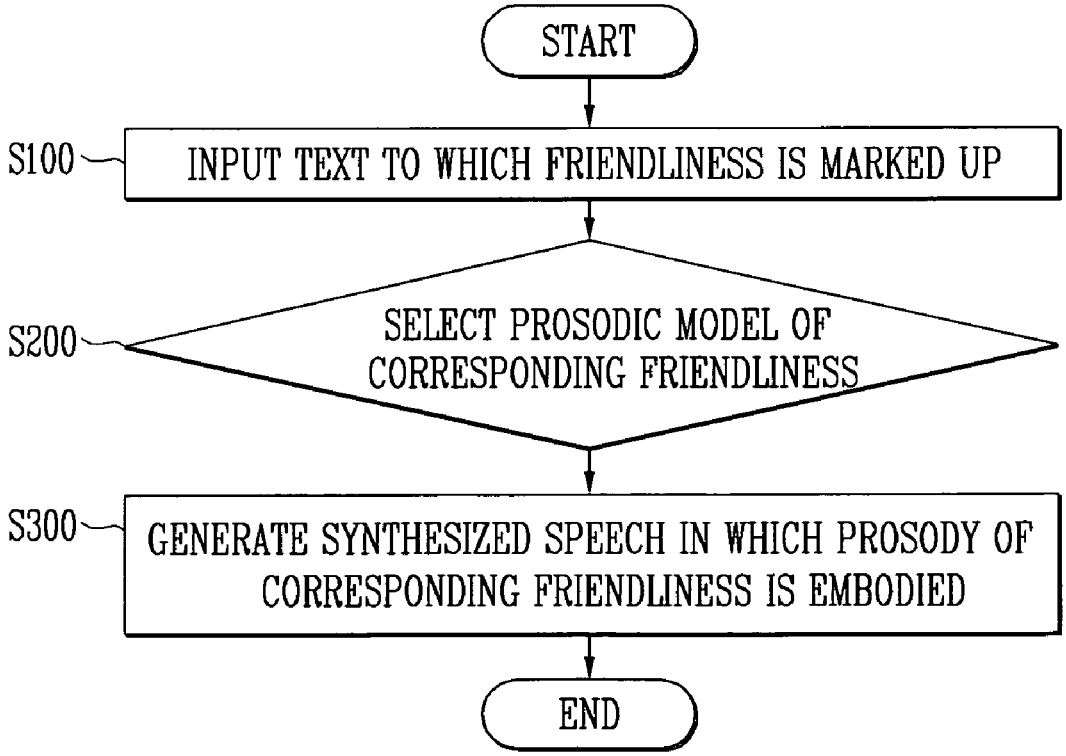
FIG. 4 is a flowchart showing a friendliness adjusting method for synthesizing conversational speech according to an exemplary embodiment of the present invention.

FIG. 4 is a flowchart showing a method for synthesizing conversational speech according to the present invention.

Referring to FIG. 4, first, a sentence to which the corresponding friendliness level has been marked up with a markup language is input (S100).

FIG. 5 shows exemplary text sentences to which friendliness level has been marked up according to an embodiment of the present invention. As shown, different friendliness levels are marked up according to whether a speaker is a counselor or a customer.

Here, the markup language, which is used to mark the friendliness level to a sentence in the present invention information, can be any one of conventional markup languages. Since a markup process is a well-known process and performed in a separate system from the synthesis system of the present invention, a detail description thereof will be omitted.

Subsequently, when the sentence that has been classified according to a plurality of friendliness levels and marked up with the friendliness level is input, the corresponding prosodic model is selected on the basis of the friendliness level and the text information of the input sentence (S200).

Then, the prosodic information of the input sentence is used as input parameters on the basis of the generated prosodic model to extract corresponding speech segments from the synthesis unit database 20. Subsequently, a synthesized speech embodying the prosody of the corresponding friendliness is generated using the selected speech segments (S300).

Here, the synthesis unit database 20 is formed by recording each sentence data in different friendliness levels and the sentence data includes at least one of a speech act, sentence type, and sentence final verbal-ending. The intonation type of the sentence is tagged through automatic or manual tagging. Thereby, not only information on the pitch, duration and energy of each phoneme but also the intonation type information of a sentence end or intonation phrase are stored in the synthesis unit database 20 of the synthesis system for adjusting friendliness.

Therefore, the speech segments extracted from the synthesis unit database 20 are synthesized to have the corresponding friendliness on the basis of the prosodic model.

As a result, through classifying the corresponding friendliness, a synthesized speech of a uniform style is generated with different friendliness according to the category of an input text or the object of the synthesizer. For example, a conversational speech synthesizer for an intelligent robot may generate more friendly synthesized speech because its conversation companion is its owner.

In other words, when conversation speech of more than two speakers is synthesized, speech of each speaker can be expressed with friendliness appropriate to the social position of the speaker and the nature of the speech.

In addition, friendliness can be selected for an entire synthesized speech, or selectively set up for a specific speech act or sentence describing specific content to generate synthesized speech.

For example, in a counseling conversation, it is natural for the counselor to speak in a more friendly style than the counseling recipient.

As described above, the speech synthesis apparatus and method according to the present invention generates speech of various styles using the speech database recorded by only a single dubbing artist, and thereby can express conversational speech more realistically and appropriately with respect to conversation topic or situation.

In addition, the present invention is not limited to the Korean language but can be modified and applied to any language and any number of languages.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A method of generating a prosodic model for controlling a speech style, comprising the steps of:

defining at least two friendliness levels;

storing recorded speech data of sentences, the sentences being made up according to each of the friendliness levels;

extracting at least one of prosodic characteristics for each of the friendliness levels from the recorded speech data, said prosodic characteristics including at least one of a sentence-final intonation type, boundary intonation types of intonation phrases in the sentence, and an average value of $F_0$ of the sentence, with respect to the recorded speech data; and generating a prosodic model for each of the friendliness levels by statistically modeling the at least one of the prosodic characteristics, wherein the prosodic model includes information comprises an "opening" speech act and sentence type, a "request-information" speech act and sentence type, a "give-information" speech act and sentence type, a "request-action" speech act and sentence type, and a "closing" speech act and sentence type.

2. The method according to claim 1, wherein the "request-action" speech act and sentence type is classified into a "wh-question" and a "yes-no question".

3. The method according to claim 1 wherein the prosodic model further comprises a "propose-action" speech act and sentence type, a "expressive" speech act and sentence type, a "commit" speech act and sentence type, a "call" speech act and sentence type, a "acknowledge" speech act and sentence type, a "statement" speech act and sentence type, a "command" speech act and sentence type, a "proposition" speech act and sentence type, and a "exclamation" speech act and sentence type.

4. The method according to claim 1, wherein the prosodic characteristic includes the characteristics of the average $F_0$ value of the sentence and the sentence-final intonation type for each of the friendliness levels.

5. A speech synthesis method for adjusting a speech style, comprising the steps of:

(a) receiving a sentence with a marked friendliness level;

(b) selecting a prosodic model based on the marked friendliness level of the sentence; and (c) generating a synthesized speech of the sentence with the marked friendliness level by obtaining speech segments from a synthesis unit database on the basis of the selected prosodic model, the synthesis unit database storing speech segments for each friendliness level wherein the selected prosodic model includes information of speech act and sentence type that comprises an "opening" speech act and sentence type, a "request-information" speech act and sentence type, a "give-information" speech act and sentence type, a "request-action" speech act and sentence type, and a "closing" speech act and sentence type.

6. The speech synthesis method according to claim 5, wherein the synthesis unit database stores sentence data and the corresponding speech segments recorded according to each friendliness level, the sentence data including information of speech act, a sentence type, or a sentence final verbal-ending or a combination thereof according to each friendliness level.

7. The speech synthesis method according to claim 5, wherein the step (c) includes the steps of:

(c1) extracting the speech segments from the synthesis unit database using prosodic information of the sentence based on the selected prosodic model; and (c2) synthesizing the extracted speech segments.

8. A speech synthesis apparatus for adjusting a speech style, comprising:

a prosodic model storage for storing prosodic models for each friendliness level, the prosodic models including sentential information and the corresponding prosodic characteristics for each friendliness level wherein the prosodic model includes an "opening" speech act and sentence type, a "request-information" speech act and sentence type, a "give-information" speech act and sentence type, a "request-action" speech act and sentence type, and a "closing" speech act and sentence type;

a synthesis unit database for storing speech segments of each friendliness level; and a speech generator for selecting the prosodic model based on a marked friendliness level of an input sentence and obtaining the speech segments from the synthesis unit database on the basis of the selected prosodic model to generate a synthesized speech of the input sentence.

* * * * *